US006390960B1

(12) United States Patent
Boland

(10) Patent No.: US 6,390,960 B1
(45) Date of Patent: May 21, 2002

(54) ABDOMINALS AND HIP EXERCISE MACHINE

(76) Inventor: Kevin O'Brien Boland, 5623 Massachusetts Ave., Bethesda, MD (US) 20816

( * ) Notice: Subject to any disclaimer, the term of this patent is extended or adjusted under 35 U.S.C. 154(b) by 0 days.

(21) Appl. No.: 09/764,356

(22) Filed: Jan. 19, 2001

Related U.S. Application Data

(60) Provisional application No. 60/226,878, filed on Aug. 23, 2000.

(51) Int. Cl.[7] ..... A63B 26/00; A63B 71/00
(52) U.S. Cl. ..... 482/140; 482/91; 482/907
(58) Field of Search ..... 482/140, 148, 482/91, 907, 908; 297/337–339, 313, DIG. 10

(56) References Cited

U.S. PATENT DOCUMENTS 4,690,457 A * 9/1987 Pouncy et al. ..... 297/337
4,979,726 A * 12/1990 Geraci ..... 297/313
5,947,876 A * 9/1999 Willey, II ..... 482/140
5,964,685 A * 10/1999 Boland ..... 482/122
6,186,926 B1 * 2/2001 Ellis ..... 482/97

* cited by examiner

*Primary Examiner*—Michael A. Brown
*Assistant Examiner*—Lori Baker Amerson
(74) *Attorney, Agent, or Firm*—A. R. Eglington

(57) ABSTRACT

A portable exercise device identified for abs and hips conditioning comprising a generally rectangular, rigid frame supporting a tilted seat and laterally aligned, handle bars used for hand bracing when the user is seated thereon. A single lever arm of an elbow configuration is transversely disposed above the seat and is adapted for pivotal lifting which is effected by the thigh movements. The device has a moment means positioned beneath the seat, which means is operatively tied to the lever arm pivot point. Resilient tensioning means are also secured to the frame and provide the variable countervailing force needed to resist the user imposed arcuate movement of the lever arm.

10 Claims, 7 Drawing Sheets

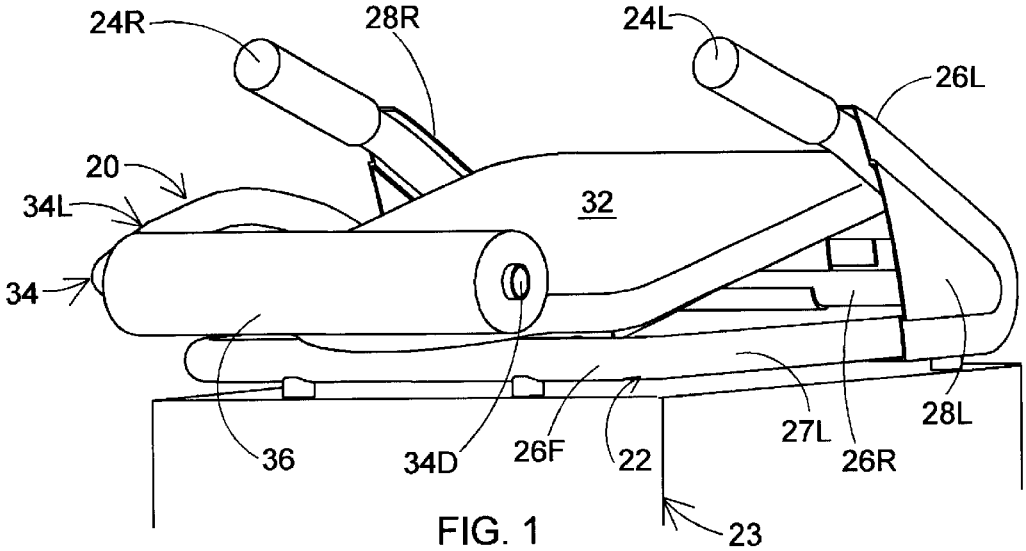
FIG. 1
FIG. 2
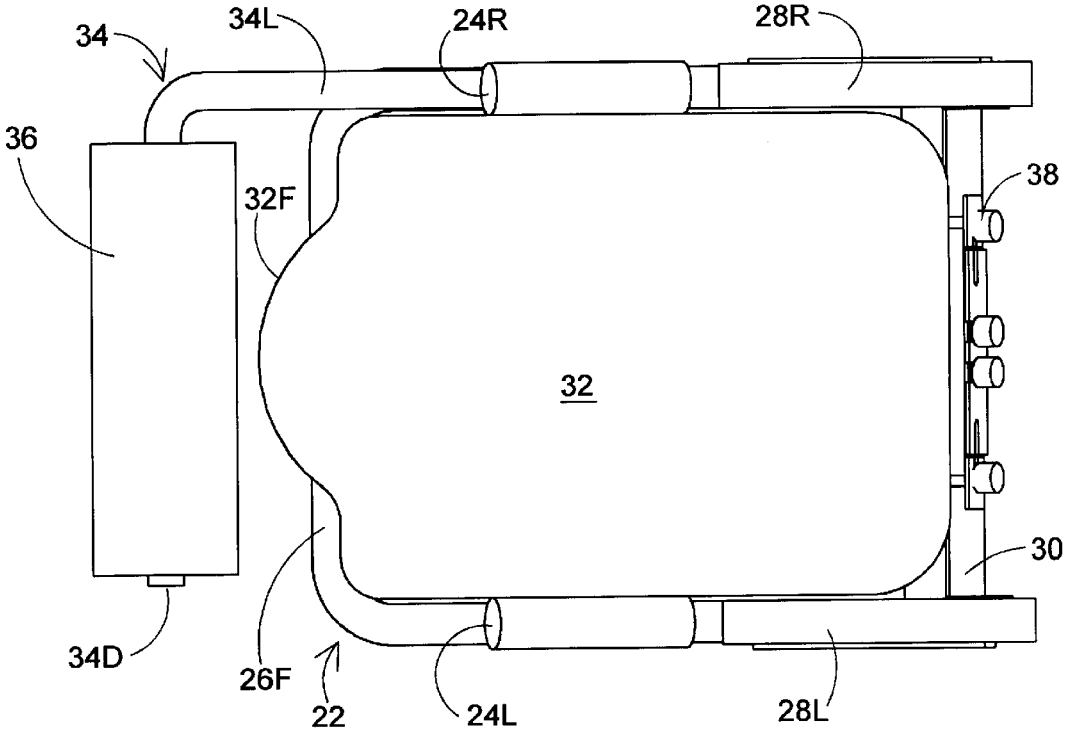

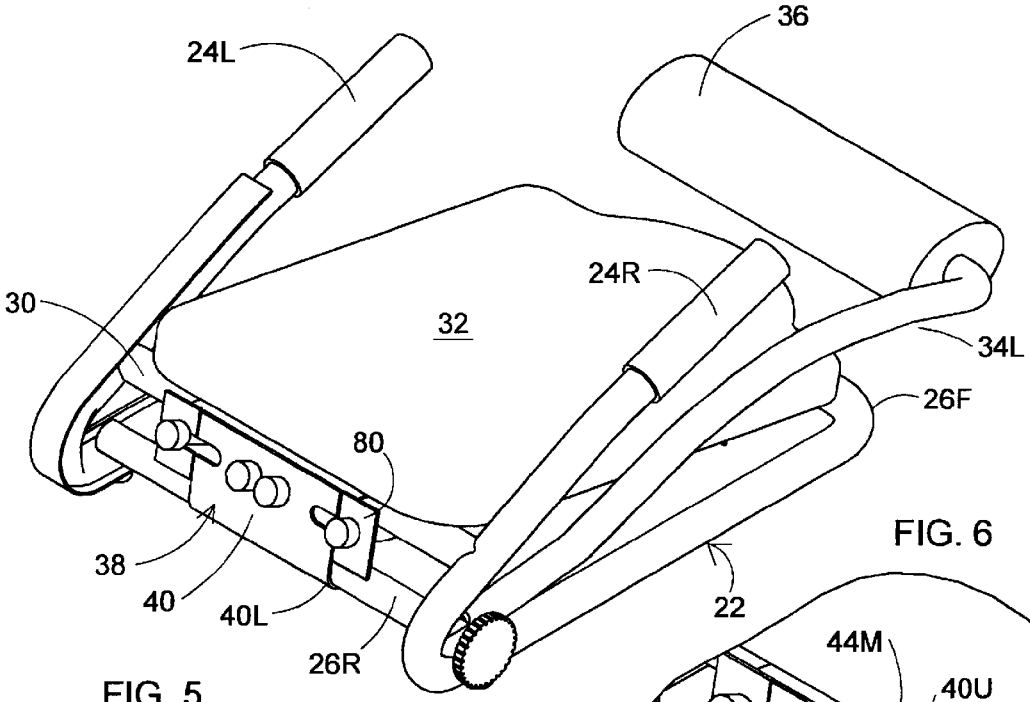
FIG. 5
FIG. 6
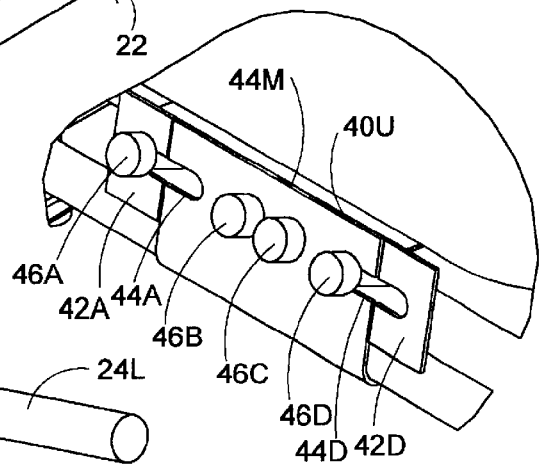
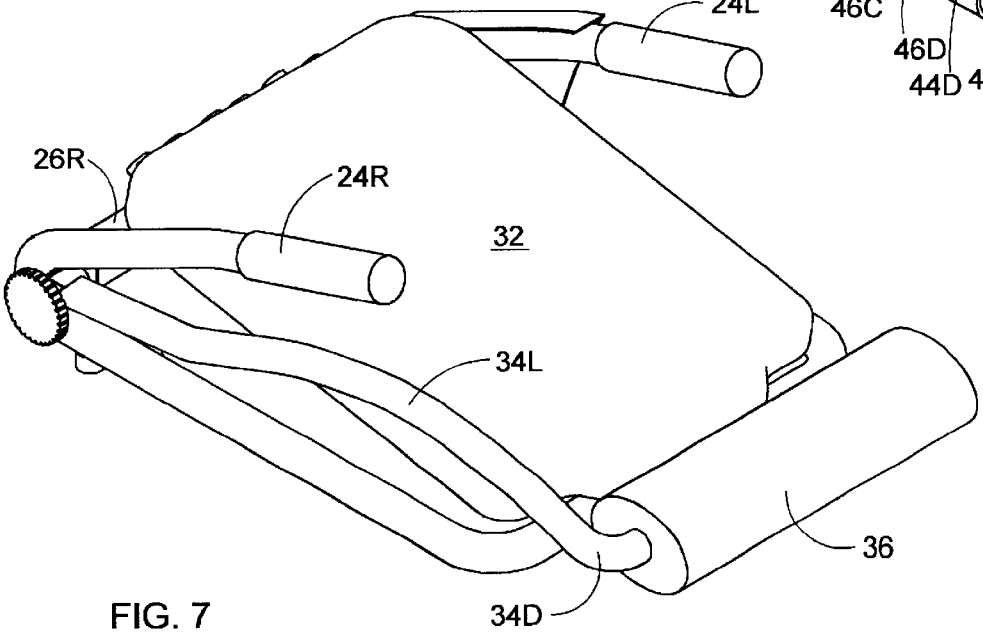
FIG. 7

ABDOMINALS AND HIP EXERCISE MACHINE

CROSS-REFERENCE TO OTHER APPLICATIONS

This is an examinable patent application titled Abdominals and Hip Exercise Machine, being submitted for an Official Filing Receipt under 35 U.S. Code §11(a). It claims priority from my co-pending provisional patent application, US S No. 60/226,878 filed Aug. 23, 2000; also Disclosure documents No. 474106, May 17, 2000; No. 470477, Mar. 10, 2000; and No. 462150, Sep. 23, 1999.

FIELD OF THE INVENTION

The present invention relates to a portable, and easily storageable, device for selective abdominal and hips exercise conditioning and development.

BACKGROUND OF THE INVENTION

It is therefore a principal object of the invention to provide a portable ABS machine which effects conditioning of the abs muscles in a manner different from known machines, by the use of one's thighs in an upward (closing) mode via a knee liftable bar, as opposed to torso pivoting to initiate the exercise.

It is still another object of the invention to exercise the user's hip, thighs, and buttocks while simultaneously working the abdominal muscles.

It is another object of the invention to provide an inclined seating means for the portable device which means gives the user more leverage over the opposing thighs in lifting bar lever and also improves the range of arcuate motion for the lifting bar.

It is a further object of the invention to provide gripping means such that the device user is easily balanced and secure while exercising, thus to preclude the tendency to sway from side to side when effecting concurrent torso and thighs movement.

It is still a further object of the invention to provide a portable abs exercise device which is mountable upon a rigid chair, and in which the body weight and arms of the user provide such stability and force which is needed to retain the device in situ during exercise.

It is still another object of the invention to provide adjustable resistant to accommodate varying user's strengths.

SUMMARY OF THE FIGURES

FIG. 1 is a frontal side, perspective view of the exercise device of the present invention while not in use, and being positioned upon a pedestal for clarity of viewing;

FIG. 2 is a top plan view of the device of FIG. 1, still idle, depicting the seating means, cushioned transverse liftable action bar, and laterally positioned, manual bracing handles;

FIG. 3S is a reduced scale, side elevation view of the device taken from the one lateral side containing the single arcuate lever member with its integral, cushioned transverse action bar; while FIG. 3S;

FIG. 5 is a rearward perspective view of the device reflecting the fixed slanted upward, seating means and underlying, frame mounted, set of knobs, which adjust to positions that determine at least three ranges of resistance available upon using the depicted device. Also, FIG. 5 shows the relationship between the knee lift bar and rearward bar, which connection affords the band resistance on the user's thighs.

FIG. 6 is a broken out, enlarged view of the rearward-mounted, knob components of FIG. 5, which will provide for adjustment of the variable resistance comprising at least three levels;

FIG. 7 is another perspective view (like that of FIG. 1), but directed to the moment arm from an opposing angle so to better depict the transverse action bar linkage;

SUMMARY OF THE INVENTION

Figure 3S:
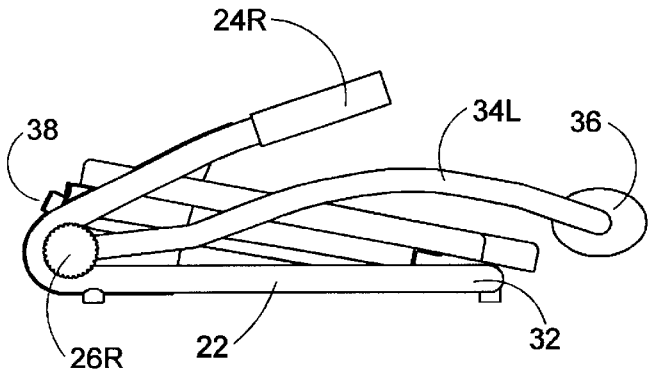

According to this invention, there is provided a multipurpose exercise device for Abs and hips comprising a rigid frame with a first and second transverse members located so that the frame is adapted to be positioned upon an armless chair as underlying support, while supporting a downwardly tilted user's seat; a pair of spaced apart, handles are anchored laterally at their proximal inner ends to the second transverse member and projecting forwardly; a third member is spaced apart from the second member and positioned bridging the space between the handle, axes, also being journaled mounted to permit its axial rotation; a single lever arm is secured pivotally at the one proximal segment thereof to the third member, while having the arm distal segment aligned transversely of the device and spaced above the level of the user's seat; and an adjustable resistance, tensioning means is adapted to provide variable resistance to the upward motion of the lever arm distal segment, which motion is induced by the drawing in thigh action of a device-seated user.

DETAILED DESCRIPTION OF THE PREFERRED EMBODIMENT

Referring now to the drawing, and to FIG. 1 in particular, there is depicted the frontal side, perspective view of an exercise device, generally 20, of the present invention for abs and hip exercise purposes. It includes a generally rectangular, rigid frame 22 (preferably of tubes and metal for lightness of transport), which is sized to be positioned firmly upon the planar component (the seat), of a conventional chair support (not seen). In this view, the device is mounted upon a display pedestal 23, merely for clarity of viewing. The rectangular frame is provided with a pair of spaced apart, elongate rods, 24L/R, serving as grippable handles, which are anchored at the inner (proximal) longitudinal ends thereof to the longitudinal ends of the rearward elongate member 26R of frame 22, forming rearward corners (optionally concealed) of the device 20. Each of the rearward corners is optionally covered by opposing support brackets, 28L/R, when included, they may serve to brace the fixed position of rods, 24L/R, while they are being subjected to manual force of the user during device usage.

A third transversely oriented, rigid bar 30 is provided, (16.2) bridging the lateral space between paired rod handles 24L/R. Bar 30 serves firstly to reinforce the fixed position of gripper rods, 24L/R, and of abutting, supporting bracket 28L/R. The bar 30 also serves to provide a horizontal support member for the rearward longitudinal edge of seating component 32, which is anchored thereto. The frontal leading edge 32F of seat component 32, and is secured to, the frontal transverse member 26F of frame 22. This provides a downward (from rear to front) inclination for seating component 32, preferably ranging from 8–10 degrees, relative to underlying horizontal frame 14.

The device 20 is provided with a single ell-shaped, lever means 34, that extends outwardly and upwardly of the frontal edge of inclined seat 32. The lateral segment, 34L, of lever arm 34, is inclined forwardly, and is attached right angularly and pivotally at its inner longitudinal end (within cover bracket 28R) to rotatable transverse bar 26R. This elongate bar 26R is adapted to rotate axially in response to the associated arcuate action of lever arm 34. The lever arm distal segment, 34D, is disposed transversely above the seating component 32, and is preferably provided with a sleeve-like resilient cushion member 36, such as of flexible foam, which serves to moderate skin abrasion on the inner thighs of a device user (not seen). The transverse bar component 34D, serves to respond to upward pressure of the conjoined thighs of the user (see FIG. 8), by pivoting upwardly and arcuately, in imposing an arcuate range of motion upon integral lateral lever segment 34. Means are provided, mounted conveniently underlying seating component 32, to provide a variable resistance range to the arcuate motion of lever arm 34, which means will be described in detail with respect to FIGS. 5 and 8.

In the top plan view of FIG. 2, a device display, corresponding to the device of FIG. 1, is depicted, with frame 22, seating component 32, lateral rods 24L/R, lever arm 34D, cushioning component 36, and lever arm 34 tensioning central panel 38 all being seen. Central panel 38 is mounted upon transverse bar 30 or moment arm 40.

The side elevation of FIG. 3S also depicts the same elements, along with the right hand side support bracket 28R, which braces the depicted gripping rod 24R. The one longitudinal end of lower transverse member 26R, to which lever arm 34 is operatively secured, is also seen.

Figure 3F:
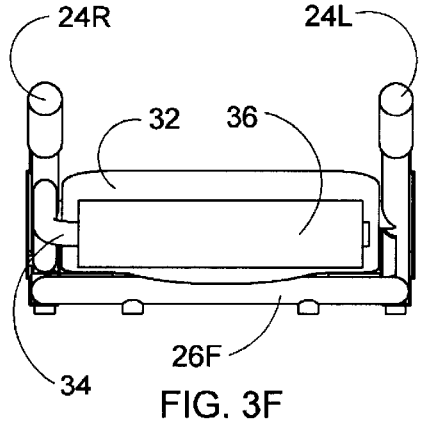
FIG. 3F is a frontal elevation view of the device fog.

In the frontal edge view of FIG. 3F, the elements are seen in the same juxtaposition as are seen in FIG. 3S.

Figure 4:
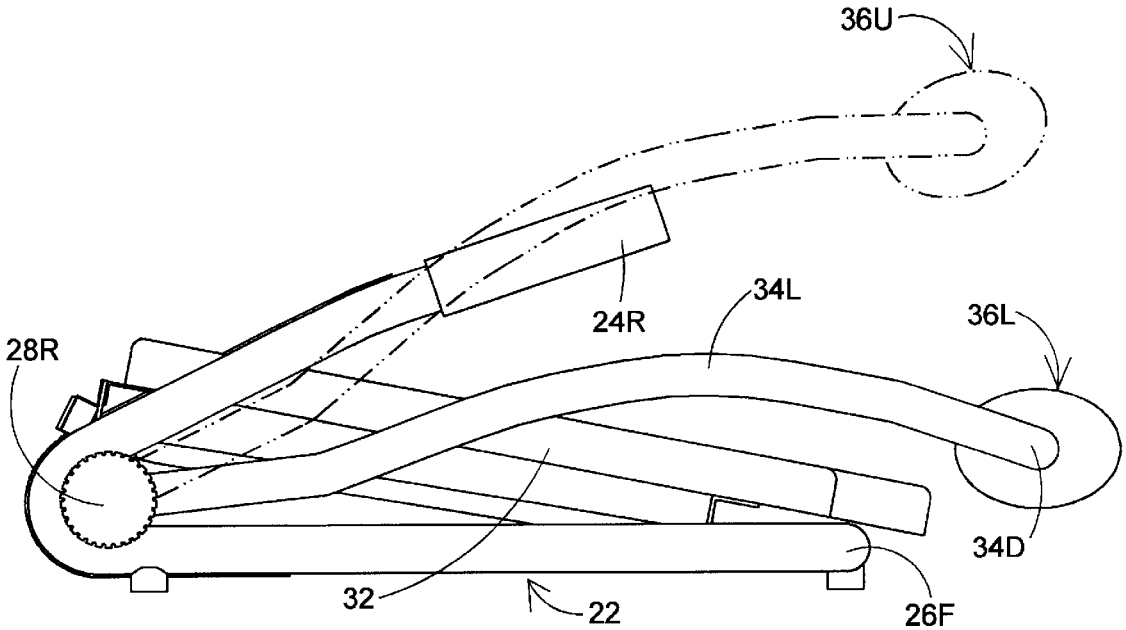
FIG. 4 is another side elevation view of the device, indicating in phantom, the range of arcuate motion that can be imposed upon the cushioned transverse action bar by a device user (not seen)

In the side elevational view of FIG. 4, like that of FIG. 3S, but is an alternate variable position (34U) of lever arm 34L, in response to device user motion, which is depicted in phantom. Manifestly, the arcuate range of motion of lever 34 is a reciprocal one, which will return to the at rest posture depicted in FIG. 3S, when thighs exerting motion is suspended against lever arm 30.

In the rearward perspective view of FIG.5, the rearward component devices, like lever arm segment 34, lower transverse member 26R (rotatable), upper transverse (fixed) member 30, and the tensioning control panel assembly 38 are depicted. In the enlarged perspective view of FIG. 6, the interaction of the movement, arm plate 40, and tensioning control means 38 can be better seen. Planar plate 40 is mounted along its lower linear edge 40L, upon the periphery of rigid member 26R, such that when member 26R is rotated by the induced movement of lever arm 34 (FIG. 5), then plate 40 pivots arcuately and rearwardly, as being tied (ganged) to rotating member 26R. Plate 40 is depicted here in the at rest position, with its upper linear edge 40U resting upon fixed transverse bar 30. Also anchored along their upper linear edges on either side of plate 40 to upper bar 30 are arrest plates 42A/D, these affording a resting slot for detached bands thereby lowering the resistance for weaker users. Each of these plates are provided with a peripheral recess, 44L, 44M, and 44R, respectively. These slots are adapted to receive shafts of projecting knobs, 46A, 46B, 46C, and 46D, respectively.

It is apparent that each of the outer knobs can be manually shifted to engage/disengage from its respective arrest slot, thereby to provide for varying the degree of resistance bias to the force user being imposed upon lever arm 34D through planar plate 38. The depicted preset engagement of central knobs, 46B/C, serve to provide a minimal range of resistance to lever arm 34 motion; such is effected by an underlying tensioning means to be described. By engaging left hand knob 46A into slot 44A, (as depicted, it is unengaged), a second higher range of resistance is provided to lever arm motion. By also engaging the right hand knob 46D in its slot 44D, (as depicted it is engaged), then a third range of higher resistance is provided to lever arm motion. The minimal level of either resistance of lever arm 34 is accomplished by the ongoing lock-end of central knobs 46B/C in associated peripheral slot 44M.

Also, the perspective view of FIG. 5 better depicts how lever arm 34L controls the pivotal rotation of transverse spanning member 36, with the latter being constrained in its arcuate movement by the tension settings on panel 38.

Figure 8:
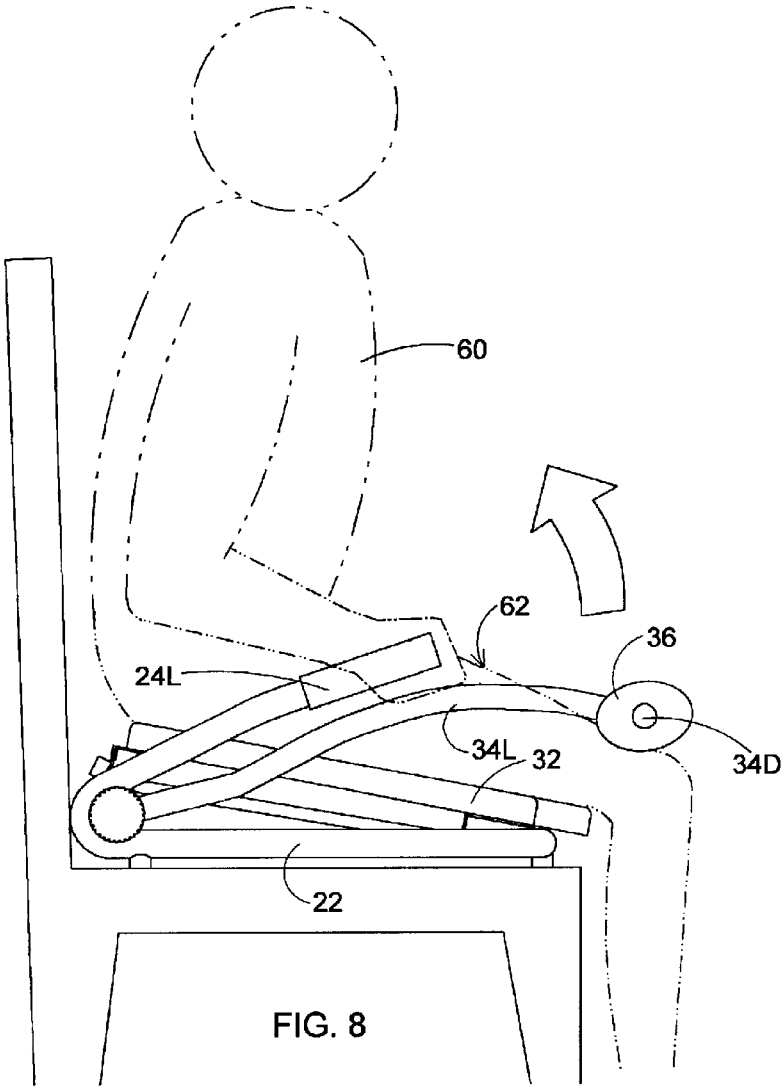
FIG. 8 is an enlarged, broken away side elevation view of the device, now with the user in the seated position and ready to activate the action bar with thighs, while the user has braced his torso by gripping the lateral handles.

In the side elevation, schematic view of FIG. 8, a user 60 is depicted seated upon inclined seating component 32, while grasping lateral side rods, 24L/R, for torso bracing, with his thighs 62 tucked under the cushioned periphery 36 of transverse arm 34D. He is now set to engage that transverse segment bar 34T by upward thigh lifting in the torso crunching motion. The range of arcuate motion achievable is depicted in FIG. 4. The greater the height of lifting of lever arm 34D, the greater then is the variable resistance imposed by the lifting lever through its associated biasing assembly 38 (FIGS. 5/6).

Figure 9:
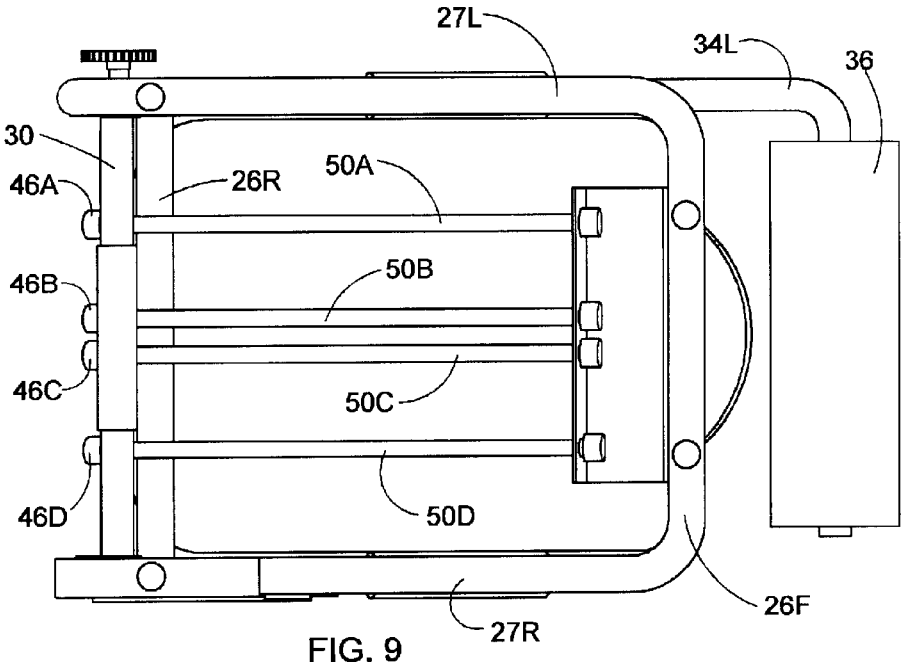
FIG. 9 is a bottom-side up, plan view of the apparatus depicting the set of tensioning means adapted for providing variable resistance to the thighs activation force imposed on the action lever of the device.

In the bottom side view of FIG. 9 the parallel set of tensioning means are depicted, comprising bungee cords 50A/B/C/D. To provide a significant level of countertension to lever arm 34 movement, the central cords, 50B/C, are strung permanently between the opposing ends. Their associated bungee-tied knobs, 46B/C, are secured permanently to the moment arm thus conferring a preset level of resistance to side deflection of lever arm 34L. Outer cords, 50A/D, are engaged, as desired. The subassembly for tying the cords at their respective longitudinal ends is described in connection with FIG. 10A/B/C.

Figure 10A:
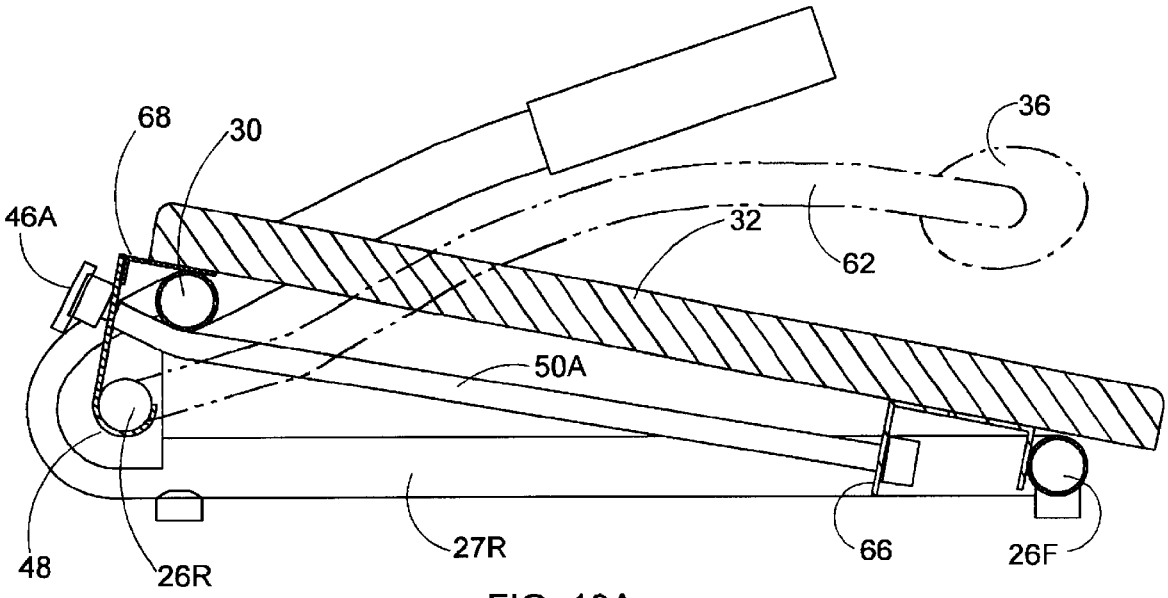
FIG. 10A is a side elevation, sectional view of the underseat portion of the apparatus depicting the overall configuration of one of the tensioning means.

In the side elevation view of FIG. 10A, one of the four tensioning means, generally 50A, are depicted anchored beneath seating component 32. The supporting cross members 26F/30, and one side member 27R, provide the anchoring points for distal connecting bracket 66, and proximal, L-shaped moment arm 40, the arcuate portion 48 of which wraps fixedly around lever member 26R. The upper longitudinal end of arm 40 is supported by (and rests upon) an angle iron bracket 68, which itself is secured on one surface to the underside of seat 32. The upper end of moment arm 40 has a peripheral slot (See FIG. 6), adapted to receive the shaft of knob 46A, and to hold its associated bungee cord 50A distended.

Figure 10B:
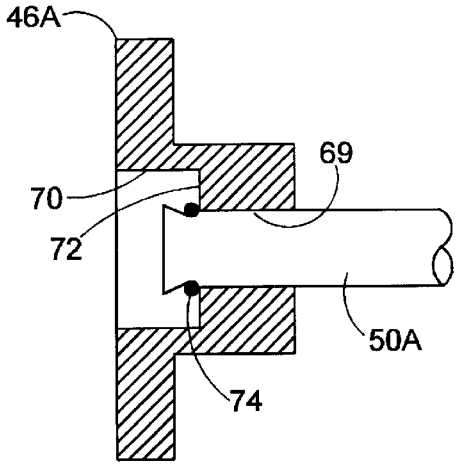
FIG. 10B is a vertical sectional view through one of the tensioning knob sets depicting how it engages and retains the tension in proximal longitudinal end of a bungee cord.

In the vertical sectional view of FIG. 10B, the means for receiving the proximal free end of each bungee cord, 50A/B/C/D, is depicted. Knob 46A has concentric axial recesses 68,70 presenting transverse internal shoulder 72, which recesses admit of the cord 50A longitudinal end. A metal circular ring 74 surrounds the cord, also being crimped to retain it permanently. The ring 74 rests on inner shoulder 72 of the knob recess, and thus arrests the cord end and holds its tensioning.

Figure 10C:
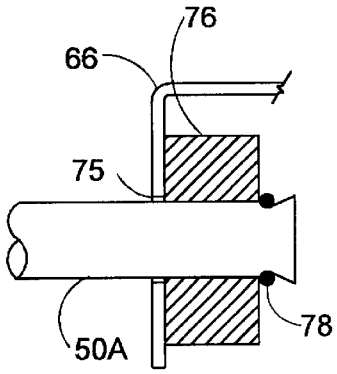
FIG. 10C is a broken away, enlarged view of the bungee cord support bracket located at the distal seat edge.

The opposing longitudinal end of cord 50A is depicted in FIG. 10C. Here, also, an underseat channel iron 66 is mounted at the distal transverse edge of the seat. A bore hole 75 in the sidewall thereof admits of the other longitudinal end of cord 50A. A resilient collar 76 is imposed between the bracket 66 sidewall, with a similar crimping ring 78, which serves to arrest the distal longitudinal end of 50A when engaged at the opposing, knobbed end.

Figure 11:
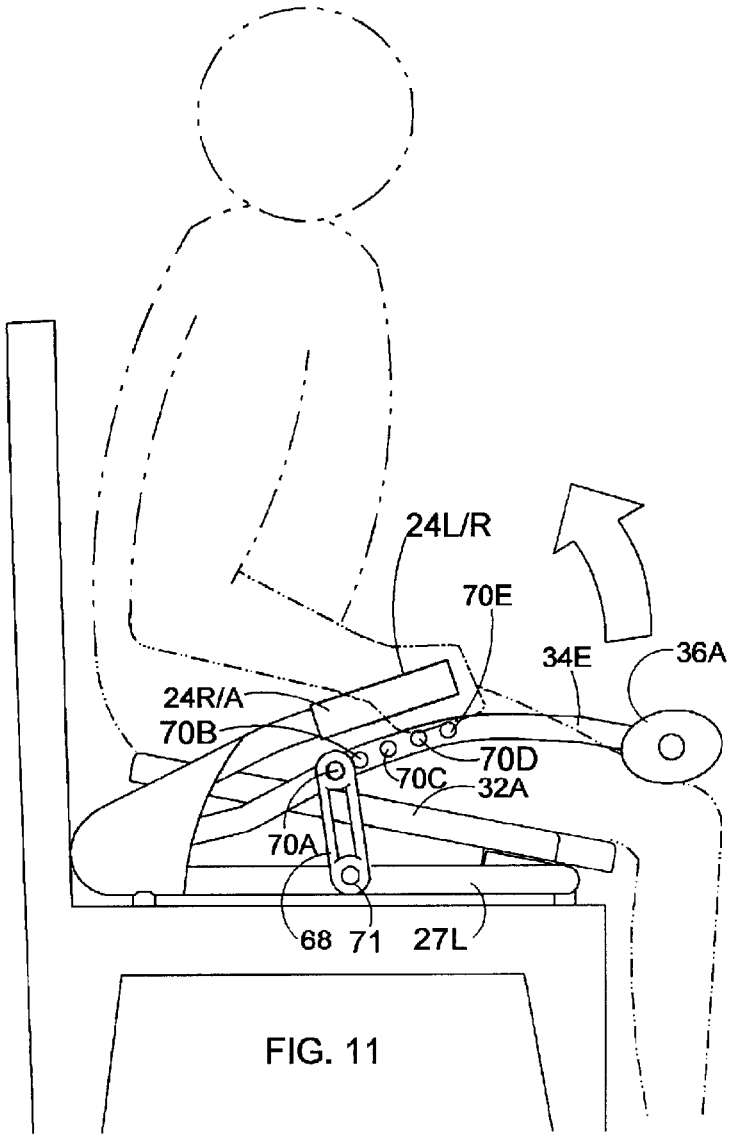
FIG. 11 is a side elevational view of an alternate embodiment of the present invention depicting an alternative configuration for the tensioning means.

In the alternative embodiment of FIG. 11, the underseat tensioning means, as depicted in the perspective views of FIGS. 5, 6, 7, 8, and 9, is replaced by a single lateral, side-mounted single band, tensioning means, generally 68. Arrayed along the mid-segment of lateral lever arm 34E, are spaced apart, set of fixed protruding metal pins, 70A/B/C/D/E. A single protruding opposing pin is mounted below them, most proximal to pin 70A upon the mid-section of right side, frame component 24R. It will be apparent, due to the bowed configuration of lateral lever arm 34E, that the vertical gap between frame pin 71 and its offset and opposing arrayed pins, 70A-E, becomes progressively larger, going from pin 70A (least) to pin 70E (most. These gaps effect a variable degree of maximum tension imposed upon the associated lever arm 34E. This is achieved by mounting a single closed loop, tensioning band 72, well known in the art, always over lower pin 71, and currently over any one of the upper arm mounted pins 70A–E. The depicted embodiment thusly provides five distinct levels of counterforce to the tensioning of band 68 imposed upon transverse bar 36A by the user with his knee/thigh uplift actions.

Figure 12:
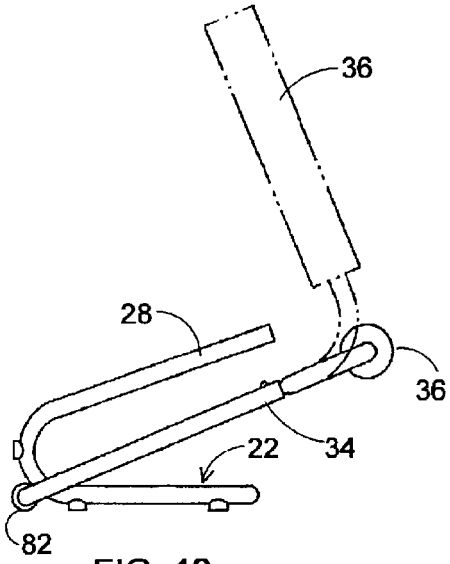
FIG. 12 is a schematic side elevational view of the device in which the action bar is pivoted at the elbow-like bend, so as to permit upward rotation of the action bar and facilitate exit of a user (not shown) from the seated position.

As to the schematic of FIG. 12/13, there show the alternative and preferred embodiment for rotating the knee lift bar 36 vertically, and out of the way. This affords easy ingress and egress for the user. The opposing support brackets 28L and 28R can only be utilized in conjunction with FIG. 12 knee bar rotating method. The alternative knee bar method shown in FIG. 13 allows the bar to rotate horizontally allowing easy user ingress and egress.

In the side elevational view of FIG. 12 is depicted another embodiment for getting on and off a first pivot point 82 is provided to permit the arcuate lifting of lever arm 34.

Figure 13:
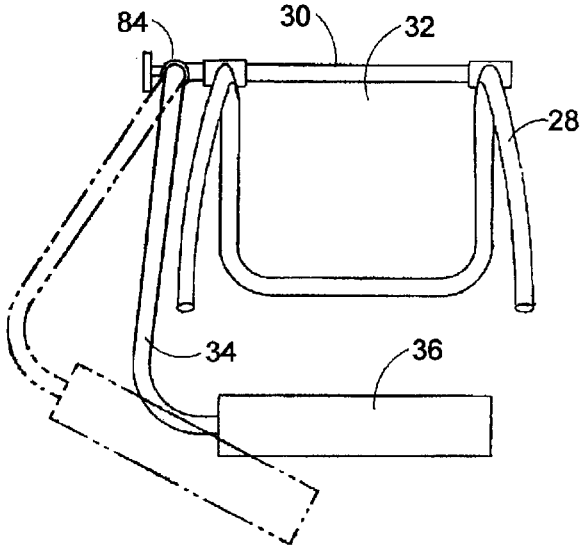
FIG. 13 is a schematic top plan view of the device of FIG. 12 depicting, in phantom, the alternate position of modified action bar swung away from the operating position to facilitate user separation; and, FIG. 14 is another embodiment of the present device in an exploded perspective view,in which the underlying components have been modified, particularly as to the counter tensioning means and operatively associated moment arm.

In the top elevational view of FIG. 13, an alternative embodiment for transverse bar release, a second pivot point 88 is provided to permit swinging out of lever arm 36 at the user choice.

Figure 14:
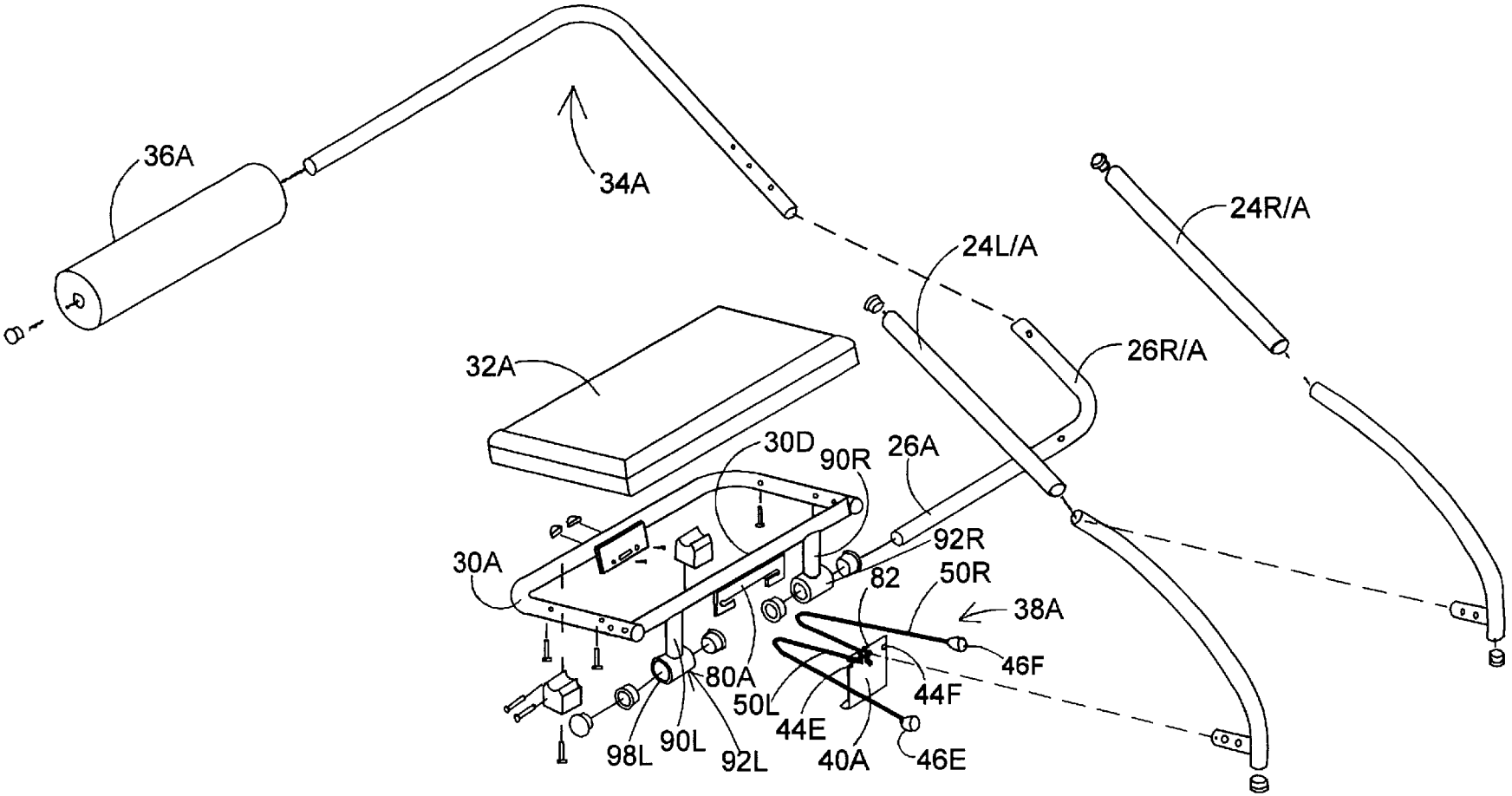

In the alternate embodiment of FIG. 14, which is an exploded view, parts common with the first embodiment of FIGS. 1 to 6, are denoted with an "A" suffix, like 36A, for the cushioned transverse members. Grippable rods, 24L/A and 24R/A; seating means 32A; Channel-shaped, under support member 30A; and rotatable transverse member, 26R/A, are essentially the same as in FIG. 45. Spaced-apart journals, 78L/R, and rearward, transverse member 26A support rotably major changes that only relate to the tensioning means, generally 38A. Arrest plate 80A is affixed to the rearward segment 30D of member 30A. Underlying frame 22A is now a rectangle, which is supported at its rearward transverse member 30D on vertical posts, 90L/R, which are provided with sleeves, 92L/R, pinned to their depending ends. Rotatable bar 26A is journaled through the spaced apart sleeves, 92L/R. Planar plate 40A, the moment arm is pinned centrally of transverse bar 26A, and again comprises the moment arm function. A single tensioning band 50L is provided at it longitudinal ends with graspable knows 46E/F. Single band 50L is adapted to be centrally engaged with the upper edge of moment arm rotation. Optional engagement of the external knobs in vertical notches, 96L/R, permits increasing the tensioning imposed upon the moment arm to a second and third increased level. This is comparable to the choices achievable with the multiple tensioning bands 50A/D/C/D of FIG. 9. Movement arm 40A has been modified to include two lateral slots, 44E/F, which provide arrest stations for the knobbed end, 46E/F, of bungee-type cords 50L/R. The other longitudinal ends of cords, 50L/R, double back after passing around bar 26A, and are then pinned fixedly along the upper edge 82 of moment arm 40A.

I claim:

1. A portable abdominal muscles and hip fitness exercise device adapted to be positioned during use on a conventional chair support, while being temporarily anchored thereto by the weight of a user seated upon the chair-seating component of the device, comprising:

(a) a generally rectangular rigid frame having a first and a second transverse members, with the frame adapted to be positioned firmly upon planar element of a conventional chair support with the second member axially mounted so as to permit axial rotation;

(b) a generally planar seating means sized to overlie the rectangular frame, being secured along its rearward edge to the rearward second transverse member, and secured along its forward edge to the forward first transverse member of the rigid frame;

(c) a pair of spaced-apart, elongate handles anchored at the inner longitudinal ends thereof, conjoined to the longitudinal ends of the second transverse member of the rigid frame, forming rearward corners with such handles projecting forwardly at an angle relative to the rigid frame;

(d) a third transverse member bridging the space between the paired elongate handles and being positioned therebetween, being spaced apart from and below the second transverse member, and being journal-mounted so as to permit the axial rotation thereof;

(e) a single L-shaped, lever arm secured pivotally at the one proximal elongate segment thereof to one longitudinal end of the third member, with the lever arm having its distal longitudinal segment aligned both transversely and horizontally, and spaced apart substantially from and above the level of the associated underlying seating means; and, (f) a tensioning means positioned under the seating means and being anchored thereto, which tensioning means is operatively associated with the proximal elongate segment of the single transverse lever arm, with such tensioning means being adapted to provide a variable resistance to the upward motion of the transversely positioned distal segment of the lever arm, the arcuate motion of which is induced by a drawing in, thigh action of the device-seated user.

2. The device of claim 1 wherein the tensioning means comprises at least one pair of longitudinally-aligned tensioning bands spaced apart, and located so as to operatively linked the tensioning means to the transverse third member, thus being adapted to provide a counterforce to the rotation being induced in the third member by its functionally associated lever arm.

3. The tensioning means of claim 2 wherein the rigging of the tensioning bands further comprises a moment arm anchored to the third transverse member and moving therewith, and an opposing detent means for interruptibly securing the first pair of longitudinal ends to an anchor point located on the rigid frame.

4. The device of claim 1 wherein at least an added first pair of tensioning bands are disposed between an anchoring point on the rigid frame and a first retention point on the moment arm so as to provide a first increased minimal level of counterforce to the user-induced rotation of the third transverse member.

5. The device of claim 4 wherein the moment arm comprises a rigid plate secured along one edge thereof, to the rotatable third member, also having peripheral slots adapted to engage the paired longitudinal ends of a third or higher number of tensioning bands and arrayed parallel to the first pair of bands.

6. The device of claim 1 wherein an added second pair of tensioning bands are disposed between an anchoring point on the rigid frame and a retention point on the moment arm so as to provide a second increased level of counterforce to the user-induced rotation of the third transverse member.

7. The device of claim 1 wherein the rearward second transverse member of the rigid frame is provided with a pair of spaced apart, depending posts that are adapted to receive and support the third transverse members and so to provide a journal box arrangement for the axial rotation of the moment arm as induced by a device user.

8. The device of claim 1 wherein the tensioning means comprises a single elongate tensioning band having its longitudinal ends anchored laterally to the moment arm periphery and its intermediate band segments interruptably anchored to the upper edge of the moment arm.

9. A portable abdominal muscles and hip fitness exercise device adapted to be positioned during use on a conventional chair support, while being temporarily anchored thereto by the weight of a user seated upon the chair-seating component of the device, comprising:

(a) a generally rectangular rigid frame having a first and a second transverse members and opposing left and right hand members conjoined to the transverse member, with the frame adapted to be positioned firmly upon planar element of a conventional chair support;

(b) a generally planar seating means sized to overlie the rectangular frame, being secured along its rearward edge to the rearward second transverse member, and secured along its forward edge to the forward first transverse member of the rigid frame;

(c) a pair of spaced-apart, elongate handles anchored at the inner longitudinal ends thereof, each conjoined to the longitudinal ends of the second transverse member of the rigid frame, forming rearward corners, with such handles projecting forwardly at an angle relative to the rigid frame;

(d) a third transverse member bridging the space between the paired elongate handles and being positioned therebetween, being spaced apart from and below the second transverse member, and being journal-mounted so as to permit the axial rotation thereof;

(e) a single L-shaped, lever arm secured pivotally at the one proximal elongate segment thereof to one longitudinal end of the third member, with the lever arm having its distal longitudinal segment aligned both transversely and horizontally, and spaced apart substantially from and above the level of the associated underlying seating means; and, (f) a tensioning means positioned on the same lateral side as the single lever arm, and being operatively associated with such arm, and further comprising:

(i) a single horizontal pin fixed intermediate the longitudinal ends of one the right hand member of the rigid frame member;

(ii) a plurality of spaced apart, protruding pins which are fixed along the middle of the proximal elongate segment of the forwardly oriented, lever arm; and, (iii) at least one closed loop, extensible band mounted straddling the single pin on the right hand member and concurrently on one of the plurality of protruding pins affixed upon the lever arm.

10. The device of claim 9 wherein the plurality of pins are arrayed upon the bowed proximal segment of the lever arm so as to provide progressively larger spans relative to the underlying, single pin from one longitudinal end of the pin array to the other longitudinal end thereof, and being adapted to be conjoined with the lower pin by the alternative selective linking employing the single extensible band.

* * * * *